US005142713A

United States Patent [19]

Makool

[11] Patent Number: 5,142,713

[45] Date of Patent: Sep. 1, 1992

[54] SHOWER-SAUNA ADAPTER

[76] Inventor: Jeffrey J. Makool, P.O. Box 237, Otis Orchards, Wash. 99027-0237

[21] Appl. No.: 728,659

[22] Filed: Jul. 11, 1991

[51] Int. Cl.[5] ..... A61H 33/10

[52] U.S. Cl. ..... 4/525; 4/533; 4/546; 4/597

[58] Field of Search ..... 4/514, 524, 525, 533, 4/534, 546, 567, 568, 570, 597, 601, 605, 615

[56] References Cited

U.S. PATENT DOCUMENTS

| | | | |
|---|---|---|---|
| 911,434 | 2/1909 | Papworth | 4/534 |
| 1,257,751 | 2/1918 | Smith | 4/568 |
| 1,872,028 | 8/1932 | Collins | 239/524 |
| 1,985,147 | 12/1934 | Carlson | 4/525 |
| 2,065,549 | 12/1936 | Balensiefer | 239/523 |
| 2,298,765 | 10/1942 | Johnson | 239/511 |
| 2,539,976 | 1/1951 | Samson et al. | 239/511 |
| 2,900,139 | 8/1959 | Hensley, Jr. | 4/605 |
| 3,007,178 | 11/1961 | Altman et al. | 4/525 |
| 3,115,645 | 12/1963 | Spence | 4/534 |
| 3,588,470 | 6/1971 | Husband | 4/524 X |
| 3,847,159 | 11/1974 | Hofer | 4/605 X |
| 3,864,760 | 2/1975 | Bowen | 4/597 |
| 4,072,397 | 2/1978 | Ross | 4/597 X |
| 4,084,271 | 4/1978 | Ginsberg | 4/524 |
| 4,303,201 | 12/1981 | Elkins et al. | 4/524 X |
| 4,327,867 | 5/1982 | Jones et al. | 239/214.23 |
| 4,365,368 | 12/1982 | Boggs | 4/596 |
| 4,432,103 | 2/1984 | Hunziker | 4/525 |

FOREIGN PATENT DOCUMENTS

| | | | |
|---|---|---|---|
| 684489 | 4/1964 | Canada | 4/534 |
| 166726 | 9/1950 | Fed. Rep. of Germany | 4/533 |
| 3244127 | 5/1984 | Fed. Rep. of Germany | 4/524 |
| 3907379 | 5/1990 | Fed. Rep. of Germany | 4/605 |
| 2593584 | 7/1987 | France | 4/524 |

*Primary Examiner*—Henry J. Recla
*Assistant Examiner*—Robert M. Fetsuga
*Attorney, Agent, or Firm*—Wells, St. John & Roberts

[57] ABSTRACT

An adapter is described for selectively converting a conventional shower to a steam sauna. The adapter includes a spray mist nozzle for developing a spray mist. In an alternative preferred form, water spray orifices are provided in addition to the spray mist nozzle and are separately controlled by a plate valve mounted to the handle with provisions for selective manual operation. The handle and attached spray nozzle are connected to the shower water outlet to selectively deliver water from the shower water outlet under pressure to the spray nozzle. A mount is provided for operably securing the spray nozzle to one of the shower stall walls; or more particularly, to a deflection plate which in turn is mountable to the one shower stall wall. The deflection plate is oriented angularly in relation to the spray nozzle to receive and deflect spray therefrom. The deflection plate also includes a diffusion surface thereon for receiving and angularly dispersing spray from a pattern produced by the spray nozzle in a substantially diffused pattern. The dome and trim effectively contain the spray and steam within the unit. Along with a plastic flap mounted above the door in some cases where the door is shorter than the shower stall, the flap is attached under the dome in between the molding and hangs down into the door to further contain the steam mist within the unit.

18 Claims, 6 Drawing Sheets

45

44
42
56
57
48
50

SHOWER-SAUNA ADAPTER

TECHNICAL FIELD

The present invention relates to adaptation of a conventional shower stall and plumbing hardware to alternatively produce water spray with dense steam or mist within the shower stall such that the shower stall may function as either a shower, a steam sauna or both, and to a nozzle configuration enabling the alternative spray or steam function.

BACKGROUND OF THE INVENTION

It is possible, by use of appropriate nozzle arrangements and through the use of warm water under pressure, to simulate a steam bath. This capability is illustrated by U.S. Pat. No. 4,084,271 to Ginsberg.

The Ginsberg patent discloses an apparatus that may be added as a retrofit device within a shower stall to simulate a steam bath. The apparatus connects to the shower head and includes a flexible hose leading to a discharge nozzle.

The nozzle is designed to emit a fine, flat spray mist of water. A bracket angles the nozzle to direct the spray mist against the vertical wall of the shower. The deflected spray mist becomes a cloud of fine hot water droplets that simulate steam.

While the Ginsberg apparatus is functional for limited purposes, the shower wall functions as a "heat sink", absorbing much of the heat from the ejected fine spray mist of water droplets. Lower temperatures are not conducive to the most comfortable and beneficial "steam" atmosphere.

Additionally, the device used in the Ginsberg arrangement for supporting the spray mist nozzle is not useful for any other purpose. The apparatus is intended only to be mounted to the wall for directing the spray mist toward the wall surface. Shrouds are provided to cover the nozzle and enable its use in a semi-permanent condition. It is desirable, however, to have the ability to selectively move and operate such a spray mist nozzle within a shower stall for additional purposes, say, rinsing the users body or the shower stall walls. It is further desirable to have the ability to convert conveniently from a mist or steam spray to a combination of such spray mist with a more conventional water stream spray.

It may be understood that even with the several advantages recognized by Ginsberg, the above problems have remained in simulation of steam within shower stalls in making the most effective use of the water temperature, and in containing the resulting mist within the shower stall for maximum benefit. A problem also remains in the inability to use the Ginsberg apparatus as a spraying arrangement to accommodate other purposes, such as personal showering or rinsing the shower stall walls.

BRIEF DESCRIPTION OF THE DRAWINGS

The preferred embodiment of the invention is illustrated in the accompanying drawings, in which.

DETAILED DESCRIPTION OF THE PREFERRED EMBODIMENTS

The following disclosure of the invention is submitted in furtherance with the constitutional purpose of the Patent Laws "to promote the progress of science and useful arts" (Article 1, Section 8).

Figure 1:
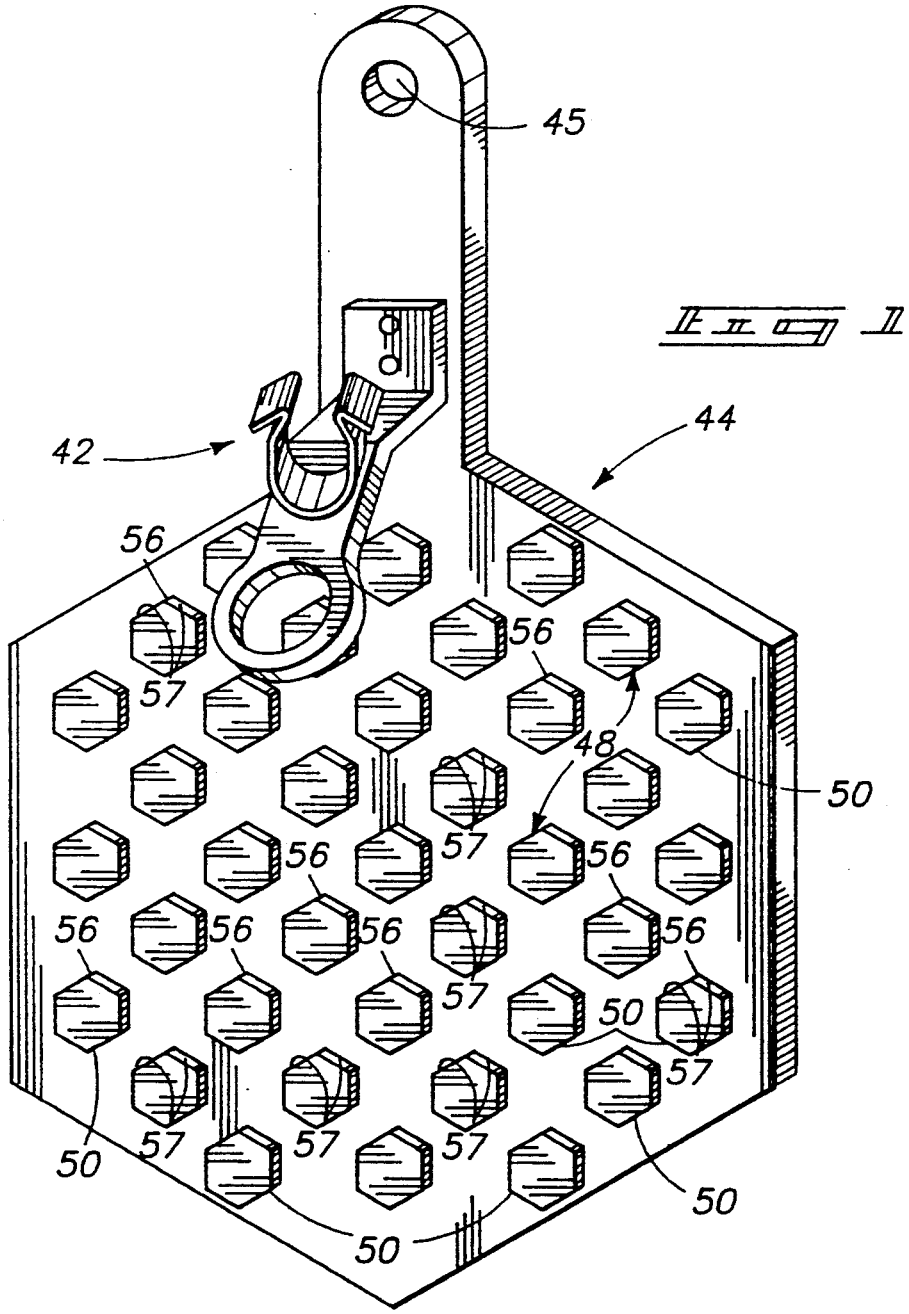
FIG. 1 is a frontal view of a deflection plate of the present invention.
Figure 2:
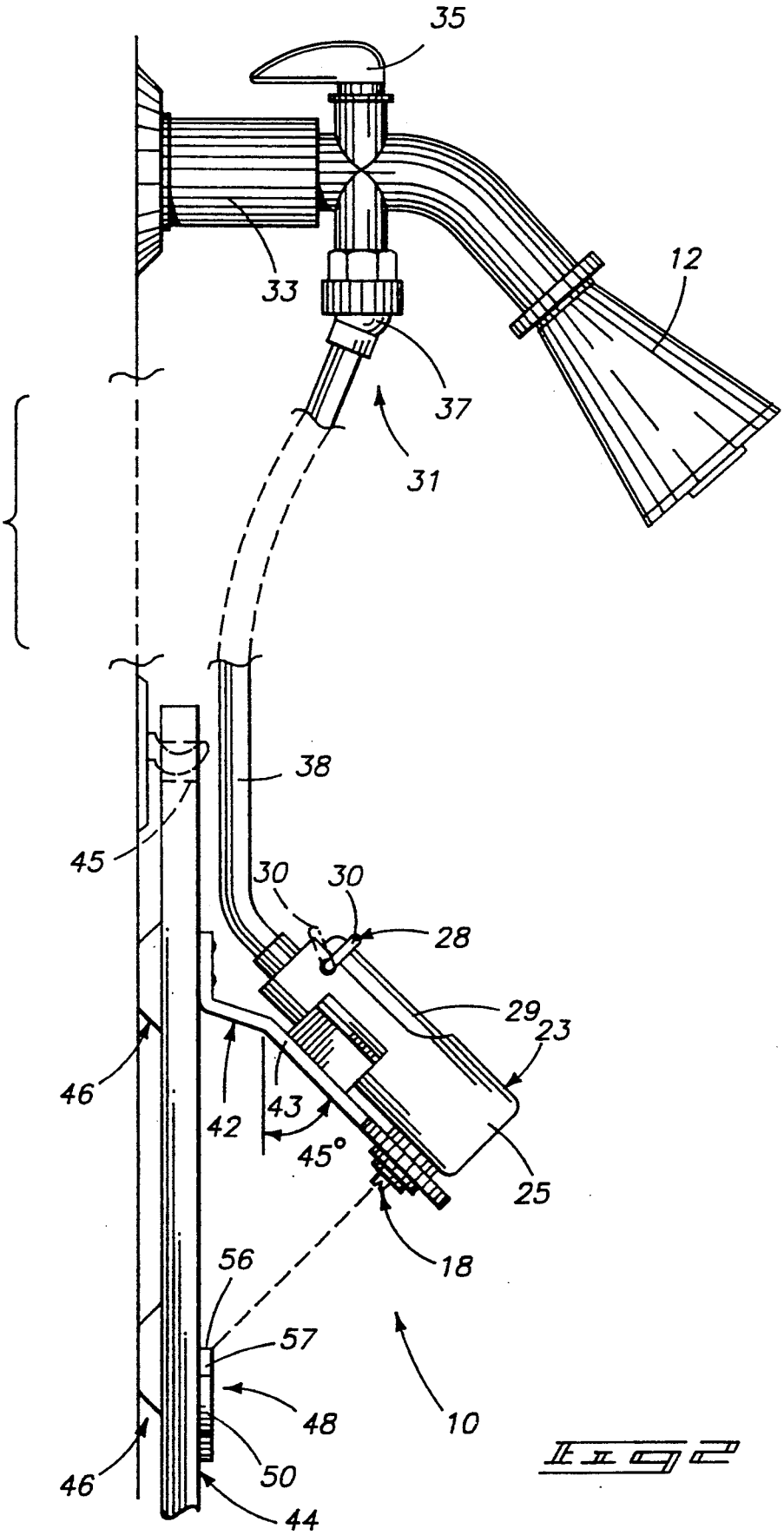
FIG. 2 is a side elevational view of the deflection plate and also showing a spray mist nozzle and flexible tube connector thereon.
Figure 3:
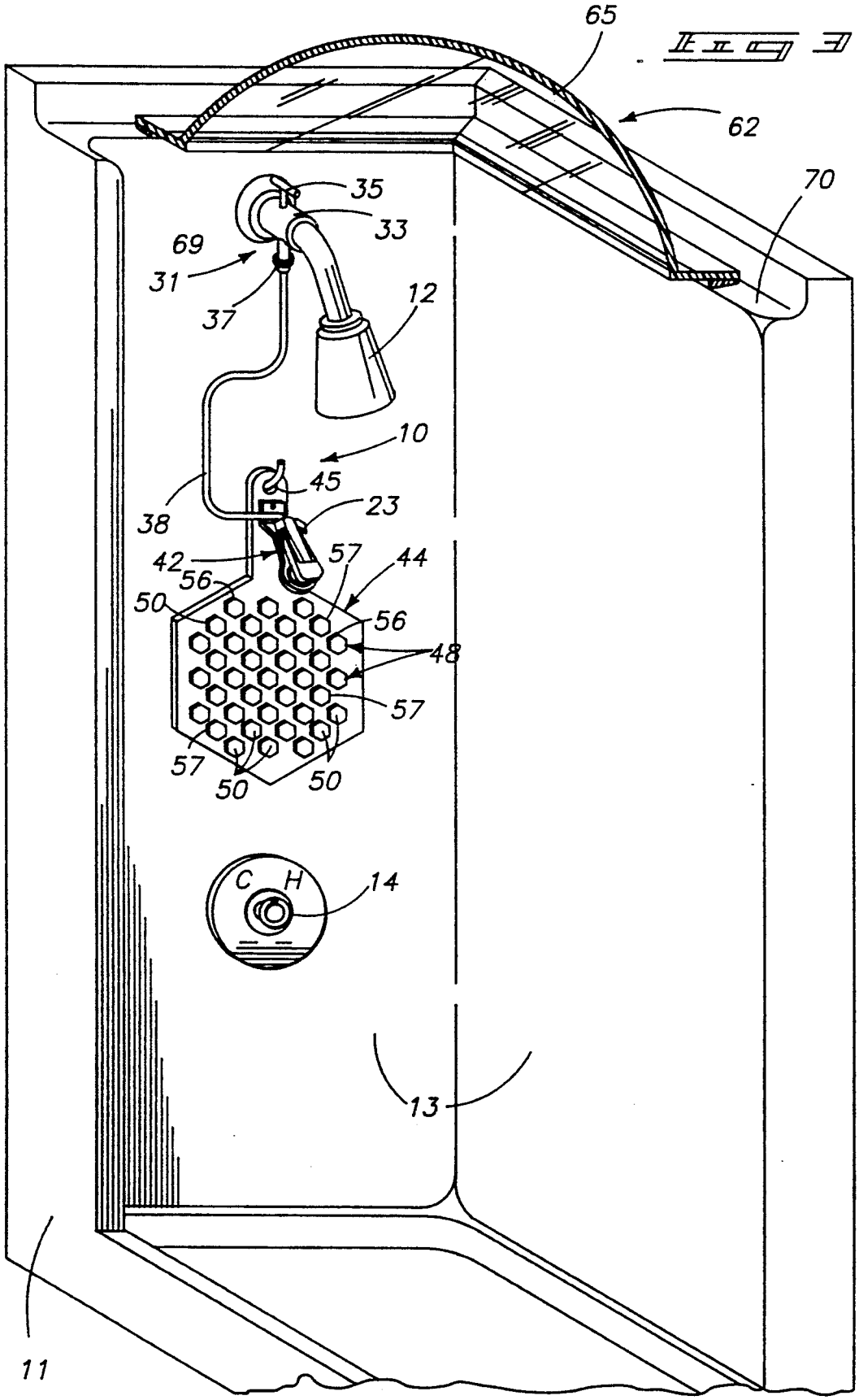
FIG. 3 is a partially fragmented pictorial view of the present adapter in use.

The present adapter is generally shown in the drawings by the reference numeral 10 (FIG. 2). The present adapter 10 is provided for use in selectively converting a conventional shower stall 11 (FIG. 3) having a shower water outlet 12 and upright shower stall walls 13 to a steam sauna. Delivery of water under pressure is selectively controlled by a conventional main shutoff valve 14.

As used herein, the term "shower" includes conventional shower stalls, shower-tubs, shower stalls with or without doors or simply tub areas that may be suited for adaption to a sauna by provision of the present invention.

In a first preferred form, the present adapter 10 includes a spray mist nozzle means 18 (FIG. 2) for developing a spray mist in a prescribed fan or broom pattern. The spray mist nozzle means 18 includes a high pressure, low volume misting nozzle tip 19 that will deliver approximately 1.5 gallons per minute at a water pressure of approximately 45 psi. The preferred nozzle tip 19 is formed (FIGS. 7, 8) to produce a flat, fan shaped spray mist pattern. Such spray mist pattern is conducive to formation of "steam" clouds or fine mists of water droplets after striking a deflecting surface.

Figure 8:
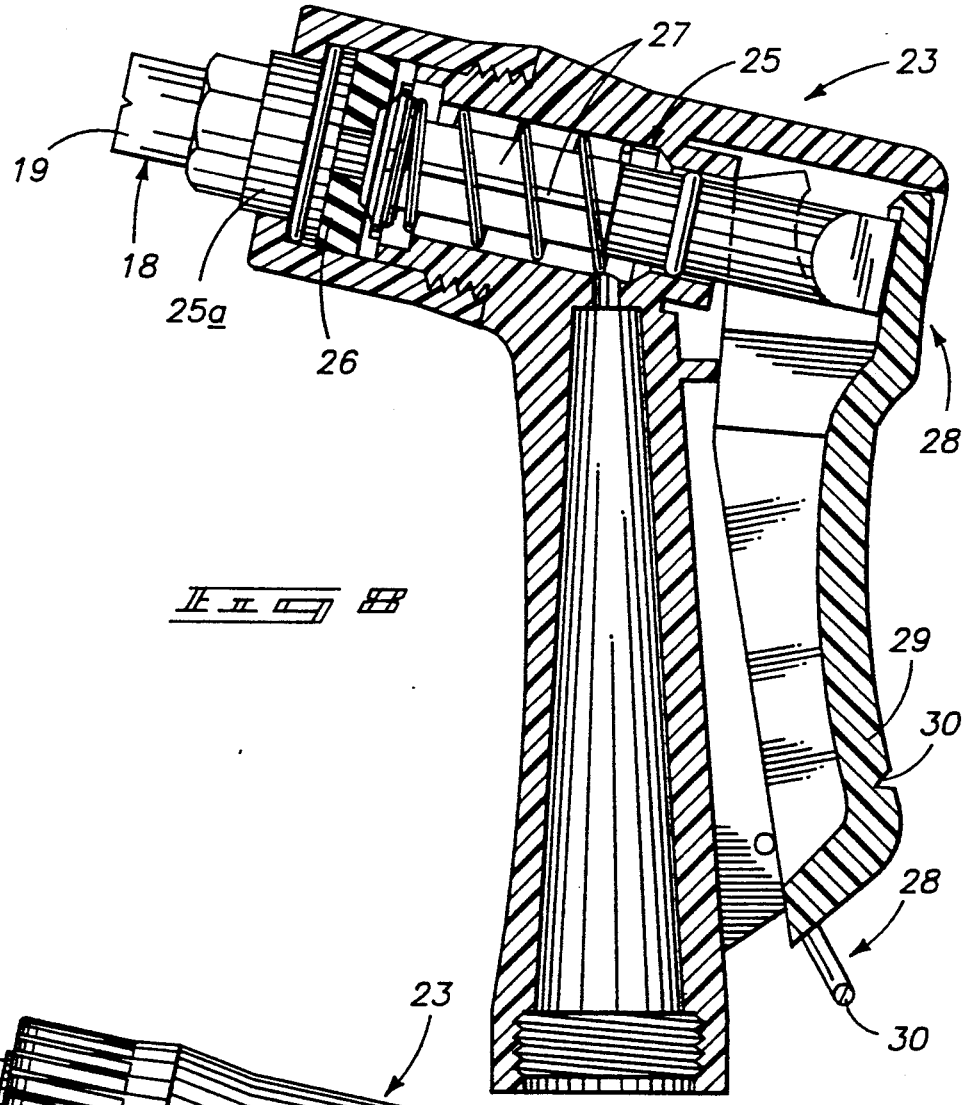
FIG. 8 is a sectional view of the spray mist nozzle shown closed.

The selected spray mist nozzle means 18 includes a fitting adaptor **25*a* which, in turn, is releasably secured within the handle housing as shown in FIG. 8, ahead or down stream of the seal 26. The adapter 25*a* is provided with an "O" ring seal sandwiched between the handle housing and the seal 26. It is internally threaded to receive the misting nozzle tip 19 of spray mist nozzle means 18**.

The selected spray mist nozzle means 18 is advantageously mounted on a handle means 23. Handle means 23 mounts the spray mist nozzle means and a valve 25 with a valve operating means 28 for manual actuation to selectively control mist discharge from the spray mist nozzle means 18. The valve 25 is operated manually by selective depression of a bar lever 29 on the handle means 23.

In the present combination, the handle 23, valve 25 and nozzle 18 present unique qualities in the ability to manually control the fine spray mist formed by the nozzle. These features enable use of the spray mist nozzle means 18 for other purposes. For example, the present spray mist nozzle means 18 is useful for rinsing dishes in a residential or commercial setting, with effective cleaning force and action much improved over conventional spray-rinsing heads. Other uses for the valve means are envisioned as well.

Figure 9:
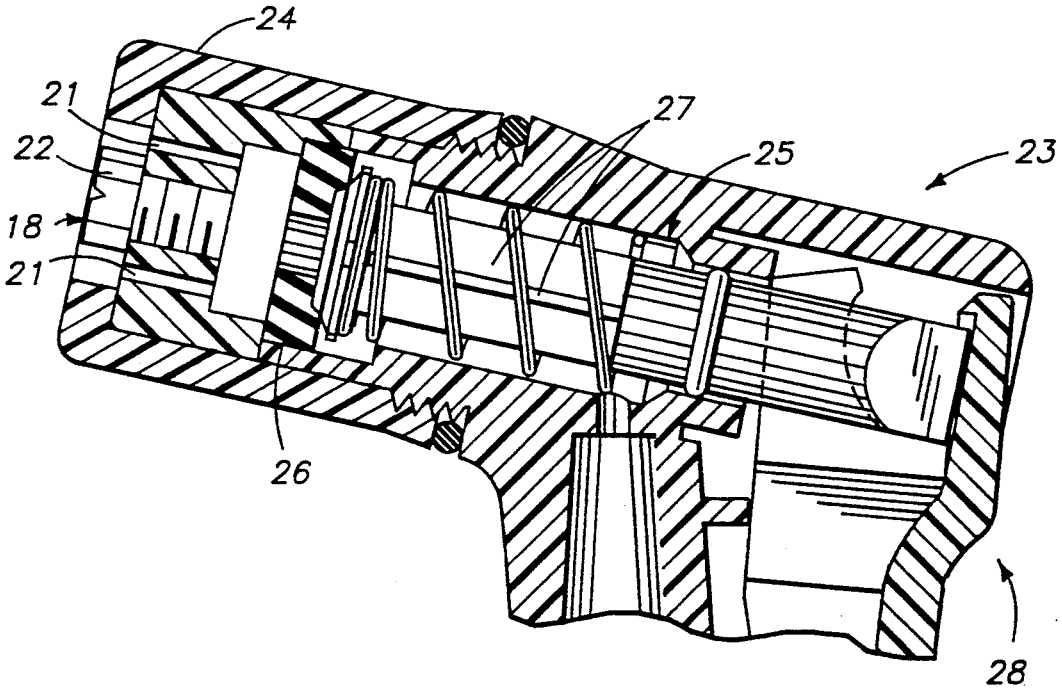
FIG. 9 is a side view of another preferred embodiment of the present spray mist nozzle including adjustment capability to allow selection of mist or mist and water spray modes.
Figure 10:
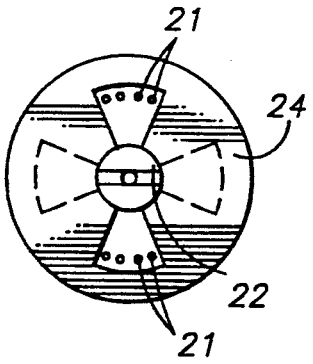
FIG. 10 is an end view of the embodiment shown in FIG. 9 with the water spray portion of the nozzle in a fully open condition.
Figure 11:
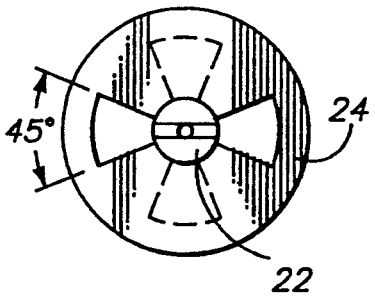
FIG. 11 is an end view similar to FIG. 10 only showing the water spray portion of the nozzle closed.

Even further usage is envisioned with the alternate preferred embodiment of the nozzle assembly 18*a* shown in FIGS. 9–11. This form uses the same handle 23 and valve 25 arrangements described above. The nozzle assembly 18*a*, however includes different provisions for enabling selective addition of a water spray through spray orifices 21 to a mist spray currently available through the a misting nozzle 22 substantially identical in operational characteristics to the nozzle tip 19 described above. The spray orifices 21 are selectively opened and closed by a slotted valve plate 24 threadably mounted to the handle means 23. FIG. 10 shows the slot of the plate in an open condition, exposing the spray orifices 21 to allow water spray to be ejected from the orifices 21, along with steam or mist from the misting nozzle 22.

Selective rotation of the plate 24 effectively converts the present valve from a steam or misting valve (FIG. 11) to a combination mist/spray valve (FIG. 10) useful especially as a personal shower head. Orifices 21 are advantageously sized to discharge approximately 1.5 gpm and emit larger jets of water than the spray from misting nozzle 22, which also emits water at approximately 1.5 gpm in a misting pattern. These larger jets of water are useful for various rinsing and washing activities where a soft spray of water is desired in addition to the mist provided through misting nozzle 22.

In both preferred forms of nozzle arrangements described above, the handle means 23 includes the manually operable valve 25 (FIGS. 8,9) with a spring biased spool 27 that is normally closed in a sealed condition against a valve seat 26. Valve 25 will open by manually depressing the pivoted valve bar lever 29.

Figure 7:
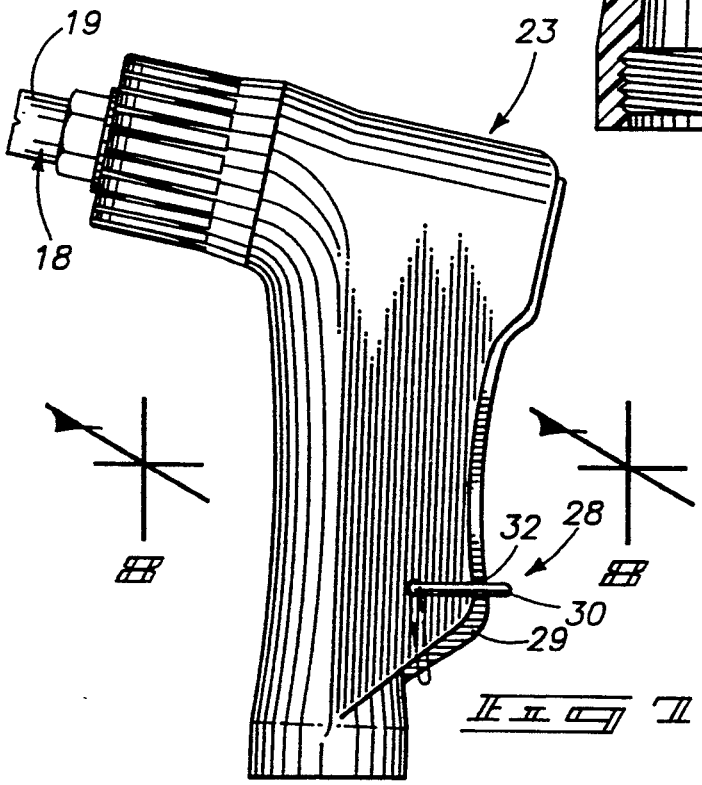
FIG. 7 is a side view of the present spray mist nozzle shown open.

A valve operating means 28 is mounted on the valve handle means 23 for selectively holding the valve in the open condition. The preferred operating means 28 includes a pivoted bale 30 mounted to the handle means 23. The bale 30 may be pivoted between an operative position, engaging and holding the valve bar lever 29 in a downward, open condition; and an inoperative position wherein the bar lever 29 is allowed to spring outwardly to close the valve 25. The bar lever 29 is advantageously notched at 32 (FIG. 8) to releasably retain the bale 30 in the operative position (FIG. 7).

The bale 30, when in the inoperative position (FIG. 8), allows the bar lever to swing outwardly to its closed position. This enables the valve spool to slide back and seal, under spring and water pressure, against the seal 26.

Means as provided at 31 (FIGS. 2, 3) for connecting the spray mist nozzle means 18 to an outlet for water under pressure. Such outlet may typically be the delivery pipe or outlet 12 for a shower head. Means 31 includes a diverter valve connector 33 and a conventional "Y" plumbing fitting with a conventional button type spool (not shown) or a 90° shutoff diverter valve 35 to intercept and selectively divert water running through the outlet 12 to the present spray mist nozzle means 18. The diverter valve 35 is supplied within the means 31 to facilitate either manual selection of the steam sauna adapter 10, or the conventional shower configuration.

Valve means 31 or the hand operable valve 25 are selectively operable, either with the ability to shut water flow off even though the water at the shower controls 14 is on and the desired temperature is set. By turning the diverter valve 35 to direct water into the valve handle means 23 with the valve 25 closed, the water flow will cease completely, thereby saving water and energy until the valve handle means 23 is put in the open position or the diverter is turned back towards the shower head. This procedure can be useful, say, when the user is shampooing or soaping the body. By simply turning the diverter 33 back to shower 12 or by opening the valve handle means 23, he or she can select steam, shower, combination of mist and spray, or none.

A ball joint 37 is also provided on the means 31. The ball joint directs the hose and holds it out of the way. Joint 37 connects to a flexible hose 38 which leads from the joint 37 to the handle means 23. The flexible hose 38 may be selected from any of a number of available flexible hoses formed of synthetic materials and frequently used for portable shower head or wand type apparatus.

The handle means 23 and spray mist nozzle means 18 may be selectively secured to the shower by a mounting means 42. Means 42 is provided to releasably secure the spray nozzle to a selected one of the shower stall walls 13. Preferably, the mounting means 42 is formed of a spring clip bracket 43 for releasably mounting the handle means 23 and spray mist nozzle means 18, and for orienting the handle means 23 and spray mist nozzle means 18 in a prescribed angular orientation.

Generally speaking, the mounting means 42 could be supplied independently and be mounted directly to a shower stall wall 13 to receive the spray mist nozzle means 18 and handle means 23. However, it is preferred that the mounting means 42 be mounted directly to a deflection plate means 44 as shown in FIG. 2.

The deflection plate means 44 is formed preferably of a rigid material and, in a preferred form includes a mounting hole 45 at a top end thereof. The hole 45 receives a conventional hook (FIGS. 2 and 3) to facilitate mounting of the plate to one of the shower stall walls.

Mounting means 42 is affixed to the deflection plate means 44 to releasably position the spray mist nozzle means 18 at a prescribed angle which will be discussed in greater detail below.

It is preferred that the deflection plate means 44 be formed of a sheet of an appropriate rigid ceramic material, with an aperture for enabling selective mounting of the device releasably within the shower stall. The ceramic material may be similar to that used for producing shower stall tiles.

The independent nature of the deflection plate means 44 is slightly raised off the wall by feet 46 to isolate the plate from the wall and better disperse heat into the air of the shower. The plate spacing and thermal properties of the ceramic material comprising the plate are such that heat may be stored within the plate and will be dissipated to the atmosphere within the shower stall. This is an advantage in that the heat is retained within the atmosphere of the shower stall, rather than being transmitted directly into the walls of the shower stall.

The deflection plate means 44 includes a diffusion surface means 48 for angularly disbursing spray mist from the pattern produced by spray mist nozzle means 18 in a substantially diffused pattern. The diffusion surface means 48 may be comprised of one or more raised projections 50 on the diffusion surface means.

The projections 50 are advantageously formed in rows and columns on the diffusion surface in a pattern to maximize interception of the spray mist being emitted from the spray mist nozzle 18. As shown, the projections 50 alternate in spacing from one row to the next.

It is preferred that each of the raised projections 50 be in a geometric polygonal configuration, preferably a hexagon. The hexagonal elevated or raised surfaces each includes an apex 56 situated between two adjacent side edges 57 of the individual hexagonal shape. In the whole pattern of projections 50, the apices 56 are oriented toward the spray mist pattern emitted from the spray mist nozzle means 18.

Adjacent sides 57 of the individual hexagonal configurations lead downwardly and away from the apices 56. The apices and angular side surfaces serve to deflect the spray mist of fine droplets in a somewhat random pattern from the deflection plate means 44. The random pattern is preferred to the predictable planar deflection pattern experienced with ordinary flat planar surfaces, such as the shower walls 13. The random deflection provided by the raised surfaces assures dispersion of the deflected mist throughout a maximum volume of the shower stall, and maximum dispersion of spray mist from the nozzle.

It is of interest to note the particular angle of the spray mist pattern to the plane of the deflection plate means 44 and the projections 50. The mounting means 42 may be adjusted (as by bending or pivoting the bracket 43) in relation to the deflection plate means 44 such that the spray mist will form an angle between 30° to 60° with the plane of the deflection plate means 44. Within the above range, a preferred angle is approximately 45° between the plane of the spray mist pattern and the plane of the deflection plate means 44. This angle is illustrated graphically in FIG. 2 with the spray mist pattern shown by dashed lines.

The angle of incidence for the spray mist being emitted from the nozzle, and the elevated, shaped configuration of the projections 50 are such that the spray mist is diffused in a substantially random manner throughout the internal volume of the shower stall. The "steam" therefore permeates the entire atmosphere within the stall for maximum benefit to the user with the hot water tank at normal average setting, set of 140° F.

The angle of the nozzle, as carried by the mounting means 42, is directed away from the user and is deflected by the deflection surface means before being dissipated into the atmosphere around the user. Thus, the user is able to avoid undesired direct contact with the spray mist. However, should the user wish, he or she may remove the handle means 23 from the mounting means 42 and selectively operate the valve to discharge spray mist as desired. This represents a substantial improvement over the existing apparatus in which the misting arrangement may be used for no other purpose.

In order to most effectively utilize the present adapter 10, a cover means 62 is provided, mountable to the walls of the shower stall for confining steam and mist within the stall.

The preferred cover means 62 includes a domed partition 65. A peripheral attachment means is supplied around the perimeter of the domed partition 65 and is useful in securing the cover to the shower stall walls 13.

The attachment means is comprised of a tapered molding 69 of triangular cross section (FIGS. 4, 5) that may be attached as by a silicone bead 67 to the shower wall and top tile edge. The configuration of the molding 69 is such that the tapered side will substantially mate with the conventional "bull nose" trim at the upper edge 70 of conventional shower stall tile or wall constructions.

Alternatively, the molding 69 may be attached directly to the shower wall (FIG. 6) above the tile top edge, if desired, by securing the short, flat surface 68 of the molding to the wall with the flat, nontapered surface facing upwardly to receive the flange 71 of the domed partition. Conventional fasteners, such as screws, may be used for this purpose. The flat upwardly facing surface 72 then receives the flange 71 of the domed partition 65.

The domed partition 65 is preferably constructed from plastic material preferably a polycarbonate such as "LEXAN" TM which can be easily trimmed and is formed by conventional procedure such as vacuum or blow molding techniques. The size of the domed partition is dictated by the size of the shower stall. Several general sizes may be provided with a large flat outer flange 71 which can be trimmed to accommodate several conventional sized shower stall dimensions, tub-shower dimensions and mobile home, camper or commercial shower and/or tub dimensions.

The dome is arched in cross sectional configuration in order to produce a "rolling" or turbulent action with the misted water droplets within the shower stall. The dome configuration also confines the mist within a smaller area than is normally afforded within the shower stall. Still further, the dome configuration may prevent saturation of the shower stall walls or ceiling above its perimeter seal and therefore avoids accumulation of condensation on these surfaces and the free passage of steam into the adjacent room. The confinement also enables quick elevation of the air temperature of the shower with a minimal amount of hot water, thereby reducing cost to user by conserving energy.

Figures 4, 5, 6:
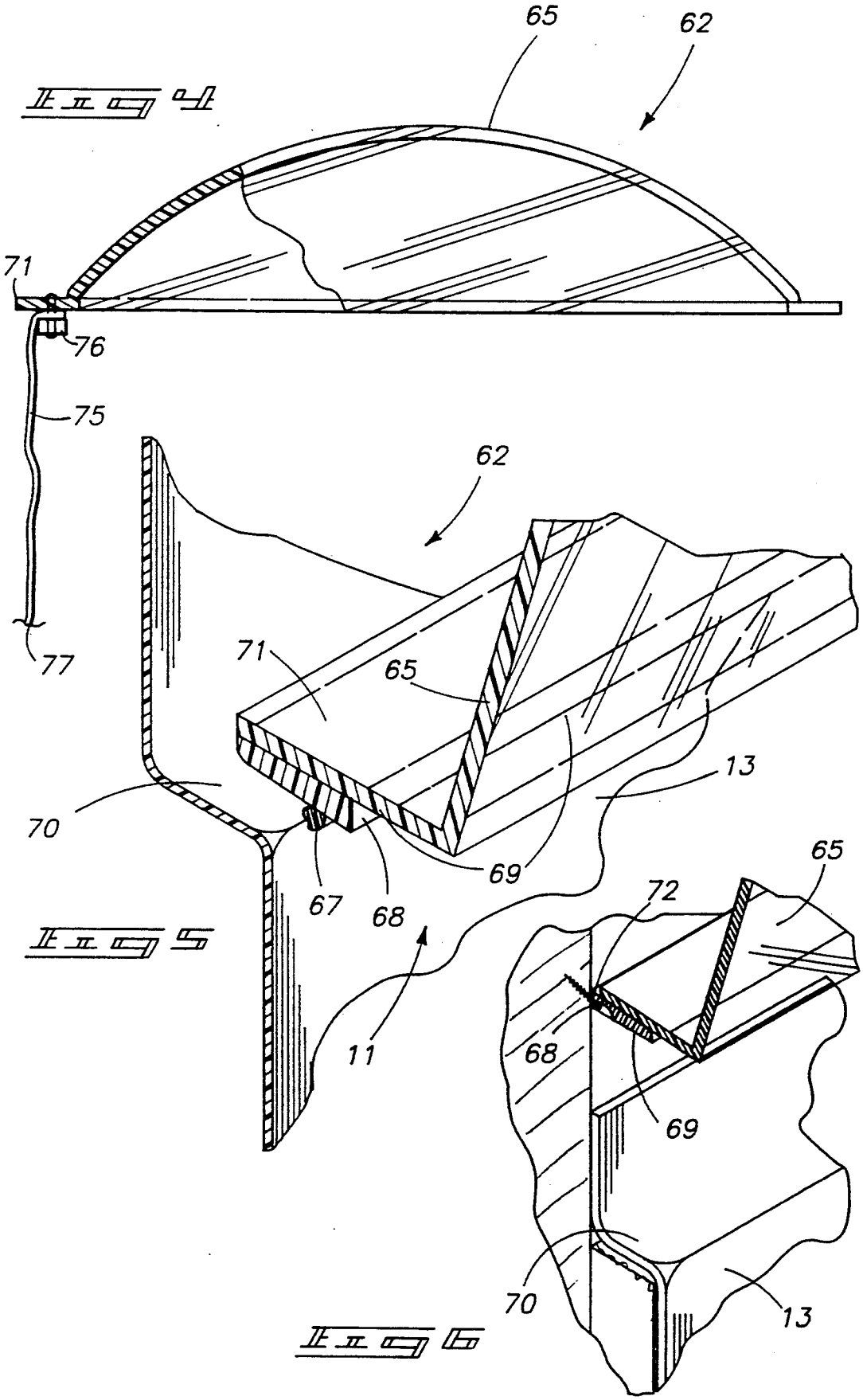
FIG. 4 is a view of a domed partition, a portion of which is shown in FIG. 3.
FIG. 5 is an enlarged detail view of a peripheral molding for the domed partition shown in FIG. 3.
FIG. 6 is an enlarged detail view of the peripheral molding attached to a wall surface.

FIG. 4 illustrates a flexible, advantageously plastic flap 75 mounted by a clamp bar 76 to part of flange 71 that would overlap a shower door (not shown) when the dome is mounted within the shower. The flap 75 extends downward to a free bottom edge 77. The dimension of the flap 75 from the flange 71 to edge 77 is to be equal to or slightly greater than the vertical distance from the flange 71 to the top of the shower door and extends along the flange to span the otherwise open area between the dome and door. The flap 75 is thus used to further contain the steam within the confined space of the shower. In showers where the shower doors extend the full height of the shower, or to the dome flange 71, the flap 75 may not be needed.

Operation of the present device is accomplished simply by initially operating the existing shower water control valves to start water flowing into the shower. The valves are manipulated until the desired water temperature is achieved. Then the user may simply operate the diverter valve 35 to change the flow of water from the shower outlet 12 to the present spray mist nozzle means 18.

Water will now flow through the spray mist nozzle means 18, or misting nozzle 22 in the alternate preferred embodiment, as a fine spray mist at only 1.5 gpm at 45 psi (which is about 50% of the new water saving shower heads now available) and will impinge upon the deflection plate means 44. This is done in the alternate preferred embodiment, with the plate valve 24 closed (FIG. 11).

The mist striking the raised projections 50 will be deflected randomly as swirling steam into the atmosphere of the shower stall. The steam will be confined and guided in a tumbling motion by the domed partition 65, and the user will be able to enjoy the full relaxation and therapeutic benefits of the shower stall now converted to a steam sauna.

The user may elect to remove the handle means 23 and the attached nozzle from the mounting means 42. This may be done simply by grasping the handle means 23 and by lifting it upwardly from the spring clip bracket 43. Here the bale 30 may selectively be pivoted clear of the lever 29, allowing the lever to move to the closed position or the lever can be squeezed manually without the bale, enabling the user to control operation of the valve 25 manually. The user is thus able to move the handle 23 and spray mist nozzle means 18 relatively freely about, due to the flexible nature of the hose 38 and the ball joint 37. The nozzle, once freed, can be used to rinse the shower stall walls, the user's hair, etc.

The spray mist nozzle means 18 is useful for this procedure, though it discharges a fine mist spray. Alternatively, if the alternate preferred nozzle arrangement is used (FIGS. 9–11) the user is free to select a different spray mist pattern. By selectively rotating the valve plate 24, the user may convert the spray mist to a more conventional water spray pattern added to the misting spray. This is done simply by rotating the valve plate to open the water spray jet orifices 21, thereby allowing water to emit from the orifices 21 and the misting nozzle 22. The open misting nozzle 22 and orifices 21 then discharge water preferably at approximately 3.0 gpm at 45 psi, rendering the present nozzle arrangement very useful as, for example, a personal shower.

When finished, the user may replace the handle means 23 in the spring clip bracket, selectively adjust the bale 30 to turn the water supply to the spray mist nozzle means off or on as desired. The diverter valve may also be selectively adjusted at this or any other time during use. This adds desirable user-selected, quick access control of the steam or water flow, thereby enabling conservation of both water and energy.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms or modifications within the proper scope of the appended claims appropriately interpreted in accordance with the doctrine of equivalents.

I claim:

1. An adapter for selectively converting a conventional shower, having a shower water outlet and upright shower stall walls, to a steam sauna, comprising:

a spray mist nozzle means for developing a spray mist in a prescribed pattern;

means for connecting the spray mist nozzle to the shower water outlet and for selectively delivering water from the shower water outlet under pressure to the spray mist nozzle;

mounting means for releasably securing the spray mist nozzle to one of the shower stall walls;

deflection plate means mountable to the one shower stall wall and adjacent to the mounting means and oriented angularly in relation to the spray mist nozzle to receive and deflect spray mist therefrom; and wherein the deflection plate means includes diffusion surface means having at least one projection secured thereon for receiving and angularly dispersing spray mist from a pattern produced by the spray mist nozzle in a substantially diffused pattern.

2. A shower-sauna adapter as claimed by claim 1, further comprising a cover means mountable to the shower stall walls for confining steam and mist within the shower stall.

3. A shower-sauna adapter as claimed by claim 1, further comprising a cover means mountable to the shower stall walls for confining steam and mist within the shower stall, and wherein the cover means is comprised of a domed partition with attachment means thereon for releasably securing the cover means to at least one of the shower stall walls.

4. A shower-sauna adapter as claimed by claim 1, further comprising a cover means mountable to the shower stall walls for confining steam and mist within the shower stall, and wherein the cover means is comprised of a domed partition with attachment means thereon for releasably securing the cover means to at least one of the shower stall walls and wherein the attachment means is comprised of a resilient molding mounted to peripheral edges of the cover means, adapted to conform to the shower stall walls.

5. A shower-sauna adapter as claimed by claim 1, wherein the deflection plate means is mounted to the mounting means.

6. A shower-sauna adapter as claimed by claim 1, wherein the deflection plate means and the mounting means are angularly oriented such that the spray mist from the spray mist nozzle means mounted to the mounting means is emitted at an angle of approximately 30 to 60 degrees to the deflection plate means.

7. A shower-sauna adapter as claimed by claim 1, wherein the deflection plate means and the mounting means are angularly oriented such that the spray mist from the spray mist nozzle means mounted to the mounting means is emitted at an angle of approximately 45 degrees to the deflection plate means.

8. A shower-sauna adapter as claimed by claim 1, wherein the means for connecting the spray mist nozzle includes a shutoff diverter valve mounted to the shower water outlet.

9. A shower-sauna adapter as claimed by claim 1, wherein the projection on the deflection plate means is of a polygonal configuration with an apex between two adjacent side edges thereof oriented toward the spray mist nozzle.

10. A shower-sauna adapter as claimed by claim 1, wherein the diffusion surface means is a pattern of projections on the deflection plate means, with each projection having a polygonal configuration with an apex between two adjacent side edges thereof oriented toward the spray mist nozzle and with the sides thereof oriented to deflect spray mist toward the apex and adjacent sides of adjacent projections.

11. A shower-sauna adapter as claimed by claim 1, further comprising a handle means mounting the spray mist nozzle means, and a manually operable valve on the handle means for manual actuation to selectively control mist discharge from the spray mist nozzle means.

12. A shower-sauna adapter as claimed by claim 1, further comprising a handle means mounting the spray mist nozzle means, and wherein the means for connecting the spray mist nozzle includes a manually operable valve on the handle means for manual actuation between an open and a closed condition to selectively control mist discharge from the spray mist nozzle means; and valve operating means on the mounting means for holding the valve in the open condition.

13. A shower-sauna adapter as claimed by claim 1, wherein the diffusion surface means is a pattern of hexagonal projections on the deflection plate means, with each hexagonal projection having an apex between two adjacent side edges thereof oriented toward the spray mist nozzle and with the two adjacent sides thereof oriented to deflect spray mist toward the apex and adjacent sides of adjacent projections.

14. A shower-sauna adapter as claimed by claim 1, wherein the diffusion surface means is a pattern of rows and columns of hexagonal projections on the deflection plate means, with each hexagonal projection having an apex between two adjacent side edges thereof oriented toward the spray mist nozzle and with the two adjacent sides thereof oriented to deflect spray mist toward the apex and adjacent sides of adjacent projections.

15. An adapter for selectively converting a conventional shower, having a shower water outlet and upright shower stall walls, to a steam sauna, comprising:

a spray mist nozzle means for developing a spray mist in a prescribed pattern;

means for connecting the spray mist nozzle to the shower water outlet and for delivering water from the shower water outlet under pressure to the spray mist nozzle;

mounting means for releasably securing the spray mist nozzle to one of the shower stall walls;

deflection plate means mounted to the mounting means with a diffusion surface thereon oriented at an angle of approximately 30 to 60 degrees from the angularly in relation to the spray mist nozzle when mounted thereto to receive and deflect spray mist therefrom;

wherein the diffusion surface means includes projections on the deflection plate means for receiving and angularly dispersing spray mist from the spray mist nozzle in a substantially diffused pattern;

wherein the projections are arranged in a pattern of rows and columns on the deflection plate means, with each projection having an apex between two adjacent side edges thereof oriented toward the spray mist nozzle and with the two adjacent sides thereof oriented to deflect spray mist toward the apex and adjacent sides of adjacent projections.

a cover means mountable to the shower stall walls for confining steam and mist within the shower stall;

wherein the cover means is comprised of a domed partition;

attachment means on the cover means for releasably securing the cover means to at least one of the shower stall walls; and wherein the attachment means is comprised of a molding mounted to peripheral edges of the cover means, adapted to conform to the shower stall walls.

16. A shower-sauna adapter as claimed by claim 15, further comprising a manually operable valve on the spray mist nozzle means for manual actuation between an open and a closed condition to selectively control mist discharge from the spray mist nozzle means; and valve operating means on the mounting means for holding the valve in the open condition.

17. A shower-sauna adapter as claimed by claim 15 wherein the molding includes a substantially triangular cross section, with a tapered side adapted to engage a shower wall along a top edge thereof, and a short, flat side adapted to alternatively engage a shower wall.

18. A shower-sauna adapter as claimed by claim 15 for showers having a shower door, and further comprising a flexible flap means mounted to the cover means and depending therefrom to span the distance between the cover means and the shower door.

* * * * *